US009478351B2

(12) United States Patent
Goeke et al.

(10) Patent No.: US 9,478,351 B2
(45) Date of Patent: Oct. 25, 2016

(54) ISOLATION TRANSFORMER FOR USE IN ISOLATED DC-TO-DC SWITCHING POWER SUPPLY

(71) Applicant: Keithley Instruments, Inc., Cleveland, OH (US)

(72) Inventors: Wayne C. Goeke, Hudson, OH (US); John C. Gibbons, Macedonia, OH (US)

(73) Assignee: KEITHLEY INSTRUMENTS, INC., Cleveland, OH (US)

( * ) Notice: Subject to any disclaimer, the term of this patent is extended or adjusted under 35 U.S.C. 154(b) by 0 days.

(21) Appl. No.: 13/902,004

(22) Filed: May 24, 2013

(65) Prior Publication Data

US 2014/0347158 A1 Nov. 27, 2014

(51) Int. Cl.

| | |
|---|---|
| ***H01F 27/36*** | (2006.01) |
| ***H01F 17/04*** | (2006.01) |
| ***H01F 27/28*** | (2006.01) |

(52) U.S. Cl.

CPC ..... *H01F 27/362* (2013.01); *H01F 27/288* (2013.01); *H01F 2027/2833* (2013.01)

(58) Field of Classification Search

CPC ..... H01F 27/362; H01F 27/367; H01F 27/2823; H01F 17/04; H01F 17/0033; H01F 17/045; H01F 27/2833; H01F 27/288; H01F 27/2885; H01F 27/36; H01F 27/365

USPC ..... 336/84 C, 221, 214, 215, 182; 174/36, 174/105 R, 108

See application file for complete search history.

(56) References Cited

U.S. PATENT DOCUMENTS

| | | | | |
|---|---|---|---|---|
| 3,314,031 | A * | 4/1967 | Jensen | H01B 7/00 174/150 |
| 3,717,808 | A | 2/1973 | Horna | |
| 3,885,085 | A * | 5/1975 | Bahder et al. | 174/36 |
| 4,507,721 | A | 3/1985 | Yamano et al. | |
| 5,304,739 | A * | 4/1994 | Klug et al. | 174/102 R |
| 6,320,385 | B1 | 11/2001 | Burl et al. | |
| 2002/0011913 | A1* | 1/2002 | Partridge et al. | 336/182 |
| 2004/0222873 | A1* | 11/2004 | Toyomura | 336/182 |
| 2006/0175078 | A1* | 8/2006 | Yumura et al. | 174/125.1 |
| 2010/0218970 | A1* | 9/2010 | Eshima | 174/108 |
| 2012/0187950 | A1* | 7/2012 | Biber | G01R 33/3685 324/322 |

FOREIGN PATENT DOCUMENTS

| | | |
|---|---|---|
| GB | 719219 A | 12/1954 |
| JP | S55154525 U | 11/1980 |
| JP | 2010272552 A | 12/2012 |

OTHER PUBLICATIONS

Extended European Search Report for European Patent Application No. 14169593.2, dated Oct. 30, 2014, 7 pages, European Patent Office, Munich.

* cited by examiner

*Primary Examiner* — Mangtin Lian

(74) *Attorney, Agent, or Firm* — Marger Johnson

(57) ABSTRACT

An isolated DC-to-DC switching power supply includes an isolation transformer having a magnetic core, a first winding around the magnetic core, a first winding-shield around the magnetic core, a second winding-shield within the first winding-shield, and a second winding within the second winding-shield. There is no direct coupling between the first winding and the second winding since the second winding is enclosed within the second winding-shield and the second winding-shield is enclosed within the first winding-shield.

14 Claims, 8 Drawing Sheets

ISOLATION TRANSFORMER FOR USE IN ISOLATED DC-TO-DC SWITCHING POWER SUPPLY

TECHNICAL FIELD

This disclosure relates to enhancing isolated DC-to-DC switching power supplies by using an isolation transformer with low leakage inductance and low isolation capacitance to reduce the noise in the isolated DC-to-DC switching power supplies.

BACKGROUND

Switching power supplies are notorious for generating electrical noise. Isolated switching power supplies, however, have added electrical noise via displacement-current across an isolation barrier of the isolated switching power supply. Normally, isolation transformers are used to provide the isolation barrier between the input and output of the switching power supply. The design of the isolation transformer, however, can greatly impact the level of electrical noise within the switching power supply.

Most isolated switching DC-to-DC power supplies use isolation transformers that contain electrostatic winding-shielding between primary and secondary windings. The goal of these transformers is to have the voltage swings of the primary winding couple only to a primary winding-shield and the voltage swings of the secondary winding couple only to a secondary winding-shield; however, the transformers currently being used still create a large amount of electrical noise across the isolation barrier. The separation of the primary windings and the secondary windings results in high leakage inductance in the transformer. High leakage inductance often increases the electrical noise of a switching power supply.

A low leakage inductance transformer construction method is to wind a transformer using a bifilar winding technique in which two wires are wound next to each other at the same time. As the wire pair is repeatedly wound around a magnetic core, each turn of the wire pair couples to other turns that then lay upon previous turns. This additional coupling changes the leakage inductance and isolation capacitance. Small changes in the winding process can cause changes to these couplings. Thus the electrostatic coupling is not well controlled causing displacement current across the isolation barrier.

Therefore, there remains a need for improved isolation transformers. In an ideal transformer, the electrostatic coupling between the primary and secondary windings is only between the primary and secondary winding-shields. The two winding-shields voltage swings are the same and thus there is no displacement current between them. The voltage swings of the primary winding couple only to a primary winding-shield and the voltage swings of a secondary winding couple only to a secondary winding-shield. Also in an ideal transformer, the leakage inductance should remain low as in a bifilar wound primary/secondary transformer.

SUMMARY

Certain embodiments of the disclosed technology include an isolation transformer for an isolated switching DC-to-DC power supply, where an electrostatic coupling between the primary and secondary windings occurs only between the primary winding-winding-shield and secondary winding-winding-shields.

Certain embodiments include an isolated DC-to-DC switching power supply including an isolation power transformer that has a magnetic core, a first winding around the magnetic core, a first winding-shield around the magnetic core, a second winding-shield within the first winding-shield, and a second winding within the second winding-shield.

DETAILED DESCRIPTION

Figure 1:
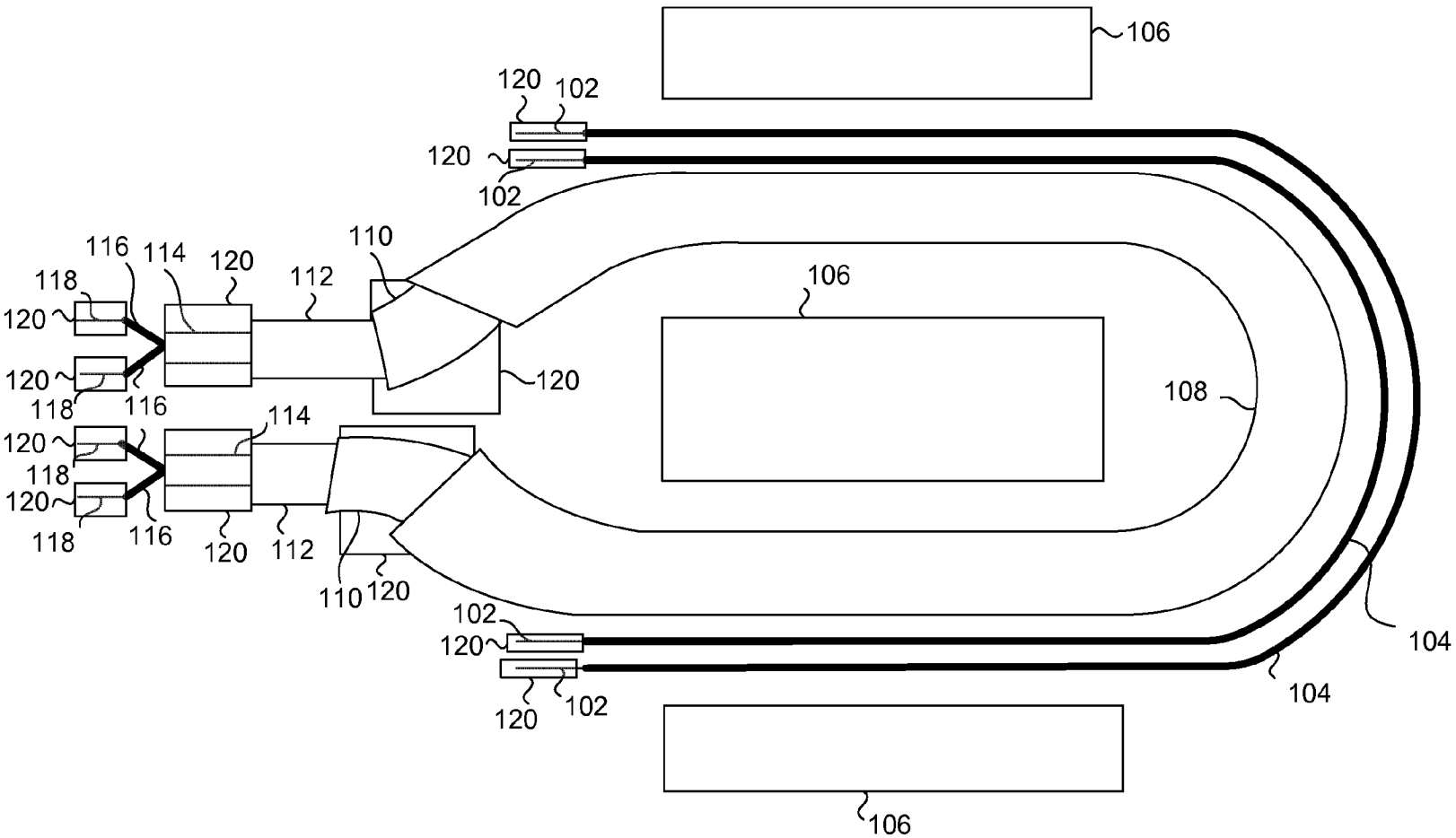
FIG. 1 illustrates an isolation transformer according to certain embodiments of the disclosed technology.

In the drawings, which are not necessarily to scale, like or corresponding elements of the disclosed systems and methods are denoted by the same reference numerals.

In order to reduce the noise in an isolated switching DC-to-DC power supply, the disclosed isolation transformers reduce the noise across the isolation barrier of the power supply. In the disclosed transformers, the coupling between the primary winding and the secondary winding is only between the first winding-shield and the second winding-shield. That is, the primary winding and the secondary winding are completely isolated from each other.

FIG. 1 is an example of an isolation transformer 100 with two first wires 102 covered by insulation layers 104 wrapped around a magnetic core 106, acting as a first winding. The isolation transformer 100 also includes a double-shielded cable wrapped around the magnetic core 106. The first two wires are external to the double-shielded cable. The double-shielded cable includes an outside insulation layer 108. The outside insulation layer 108 encloses an outer electrostatic winding-shield 110, a first insulation layer 112, an inner electrostatic winding-shield 114, two second insulation layers 116, and two second wires 118. "Electrostatic winding-shield" will also be referred to as a "winding-shield" throughout the specification. The two second wires 118 are each covered with second insulation layers 116. The two second wires 118 and the second insulation layers 116 are located inside the inner winding-shield 114, which is located inside the outer winding-shield 110. Each of the first wires 102, second wires 118, outer winding-shield 110 and inner winding-shield 114 are soldered at soldering points 120 to a circuit board. In the double-shielded cable, the inner winding-shield 114 and the outer winding-shield 110 are composed of copper braided sheaths.

Figure 2:
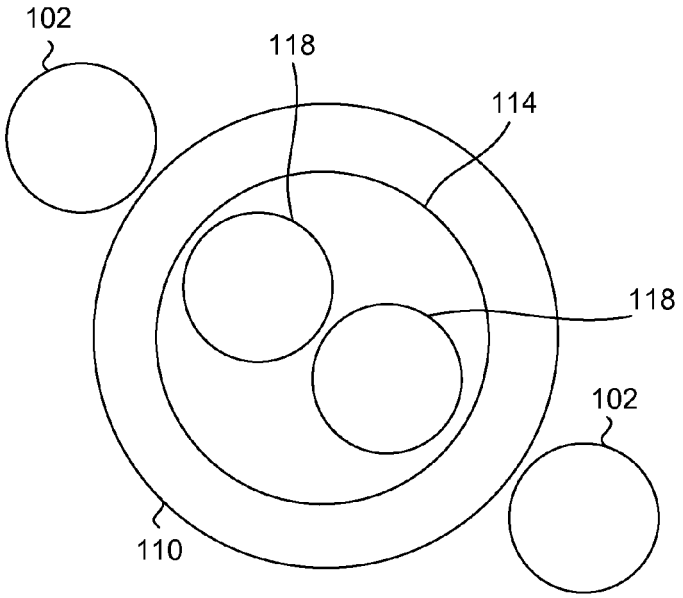
FIG. 2 is a cross-section view of the cables and external wires of the isolation transformer shown in FIG. 1.

A cross-section of the layers of the double-shielded cable along with the first wires 102 external to the double-shielded cable are shown in FIG. 2. The first wires 102 and the second wires 118 can both be either the primary or secondary windings of the transformer, as will be readily understood by one of ordinary skill in the art. For ease of discussion, the second wires 118 will be referred together as the primary winding, and the first wires 102 will be referred together as the secondary winding. In this arrangement, the inner winding-shield 114 acts as the primary winding-shield and the outer winding-shield 110 acts as the secondary winding-shield. Since the primary winding is fully encased within the primary winding-shield and the primary winding-shield is fully encased in the secondary winding-shield, there is no direct coupling between the primary winding and the secondary winding. Therefore, the voltage swing of the primary winding couples only to the primary winding-shield and the voltage swing of the secondary winding couples only to the secondary winding-shield. The capacitance between the two winding-shields is not charged or discharged. Therefore, there is no charge flow from the primary winding-shield to the secondary winding-shield.

In this embodiment shown in FIG. 1, the center windings of the transformer of both the first wires 102 and the second wires 118 have the same voltage as the outer winding-shield 110 and the inner winding-shield 114. Due to this feature, the outer winding-shield 110, or secondary winding-shield, can be used as a center turn of the secondary winding of the transformer, and the inner winding-shield 114, or primary winding-shield, can be used as a center turn of the primary winding of the transformer.

Rather than a double-shield cable, this embodiment includes a coaxial cable. If a coaxial cable is used, the first wires 102 would still be external to the coaxial cable. It may be desirable to use a single first wire 102 or more wires that the two first wires shows in FIG. 1. The coaxial cable includes a center conductor, an inner insulation layer, an outer conductor, and an outer insulation layer. Within the coaxial cable, the center conductor would function as both the second winding-shield and the second winding. The outer conductor would function as the first winding shield.

Figure 4:
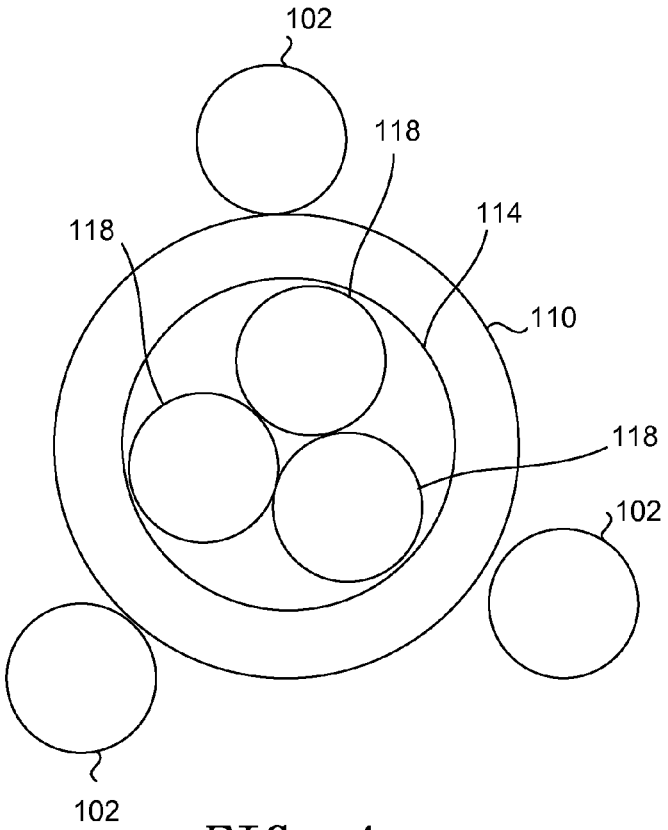
FIG. 4 is a cross-section view of the cables and external wires of the isolation transformer shown in FIG. 3.
Figure 3:
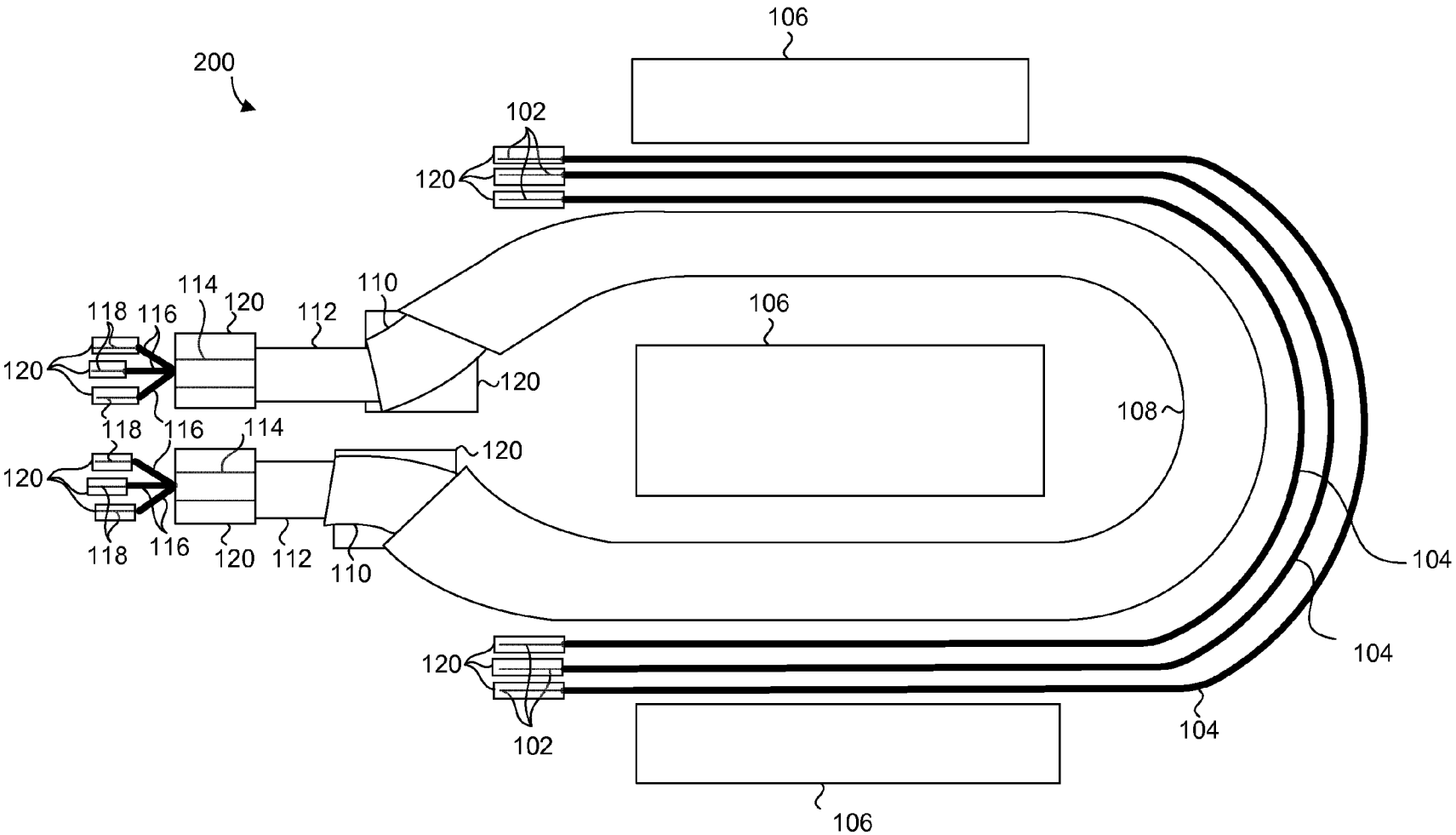
FIG. 3 illustrates an isolation transformer according to other embodiments of the disclosed technology.

FIG. 3 shows an embodiment similar to that of FIG. 1. However, in this embodiment, three first wires 102 are used in an isolation transformer 200, along with three second wires 118. Each of the three first wires 102 and each of the three second wires 118 has its own insulation layer 104 and 116, respectively. The remainder of this embodiment is the same as the embodiment discussed above with regard to FIG. 1. A cross-section of the double-shielded cable of this embodiment, along with the three external first wires, is shown in FIG. 4. In this embodiment, for ease of discussion, the three second wires 118 again comprise the primary winding and the three first wires 102 comprise the secondary winding. Each turn of the primary winding is a second wire 118. Therefore, the three turns of the primary winding (the three second wires 118) are completely enclosed within the inner winding-shield 114, also referred to as the primary winding-shield, and the outer winding-shield 110, also referred to as the secondary winding-shield.

The configuration of the transformer in FIG. 3 provides that the coupling between the primary winding and the secondary winding occurs only between the primary winding-shield and the secondary winding-shield. Again, there is no direct coupling between the primary and secondary windings and the voltage swing of the primary winding couples only to the primary winding-shield and the voltage swing of the secondary winding couples only to the secondary winding-shield.

Figure 5:
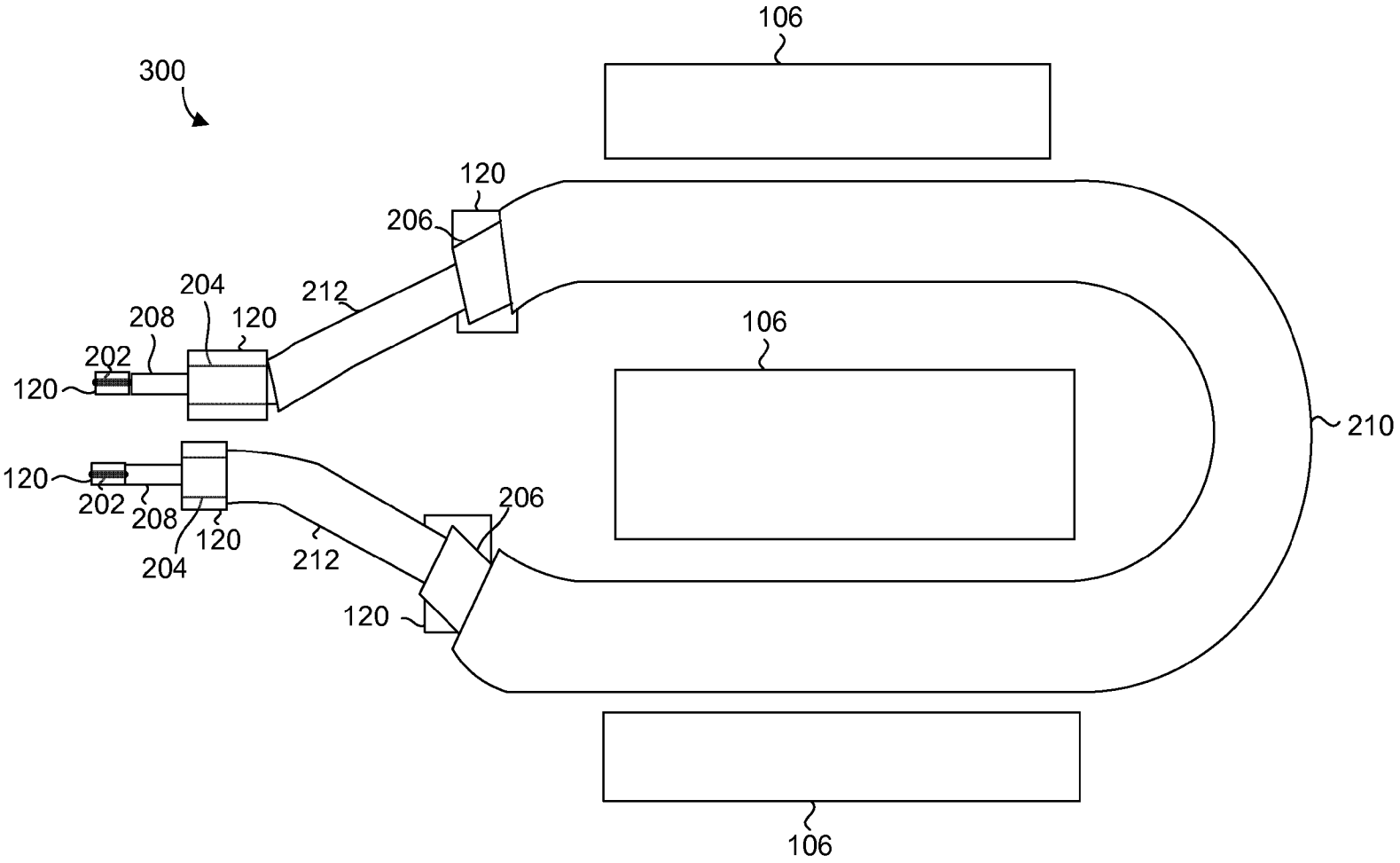
FIG. 5 illustrates an isolation transformer according to certain embodiments of the disclosed technology.
Figure 6:
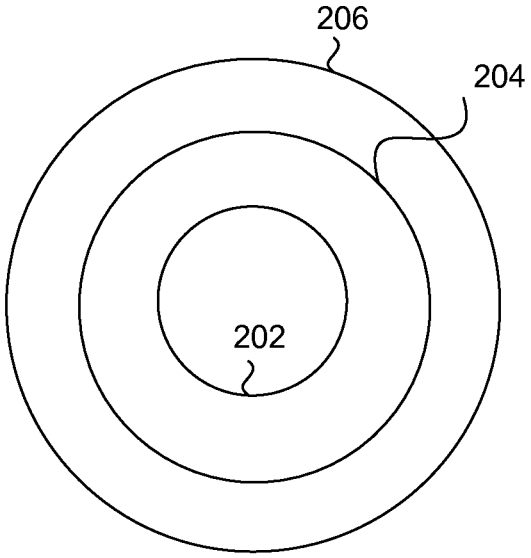
FIG. 6 is a cross-section view of the cable of the isolation transformer shown in FIG. 5.

Another embodiment is shown in FIG. 5. In this embodiment, an isolation transformer 300 is built using a single triaxial cable around the magnetic core 106. The triaxial cable is wound around the magnetic core 106 a single time. The isolation transformer 300 has two isolated secondary windings. The triaxial cable includes a conductor 202, a braided sheath 204, and another braided sheath 206. This configuration can be seen in the cross-section of the triaxial cable in FIG. 6. Further, as shown in FIG. 5, each of these layers includes an insulation layer 208 and 212 between them, with a final insulation layer 210 on the outside. Each conductor of the triaxial cable, including conductor 202 and braided sheaths 204 and 206 can be independent windings of the transformer and winding-shields. Therefore, the isolation transformer 300, for example, can have a primary winding (conductor 202) and two secondary windings (braided sheaths 204 and 206, referred to herein as first secondary winding and second secondary winding, respectively). No wires are external to the triaxial cable in this embodiment. The two braided sheaths 204 and 206, however, still act as a primary and secondary winding-shield, respectively, as well. As will be readily understood by one of ordinary skill in the art, the conductor 202 could be the secondary winding and the two braided sheaths 204 and 206 could be the two primary windings.

Both the primary winding of conductor 202 and the secondary winding of braided sheath 206 are independent due to the braided sheath 204. The second secondary winding, braided sheath 206, has no direct coupling to the primary winding, conductor 202. Again, in this embodiment there will be capacitance between the braided sheath 204 and conductor 206. This capacitance, however, is not charged or discharged.

In an alternative to this embodiment (not shown), external wires may be provided outside the triaxial cable, providing more turns to the primary winding, similar to that shown in FIGS. 1 and 3. These external wires of the primary winding will still be shielded from the conductor 202 due to the braided sheath 206.

In another alternative to this embodiment, a coaxial cable may be used in place of the triaxial cable. In this configuration, the inner conductor of the coaxial cable would act both as a second winding-shield and the second winding. The outer conductor would act as both a first winding-shield and the first winding.

Figure 7:
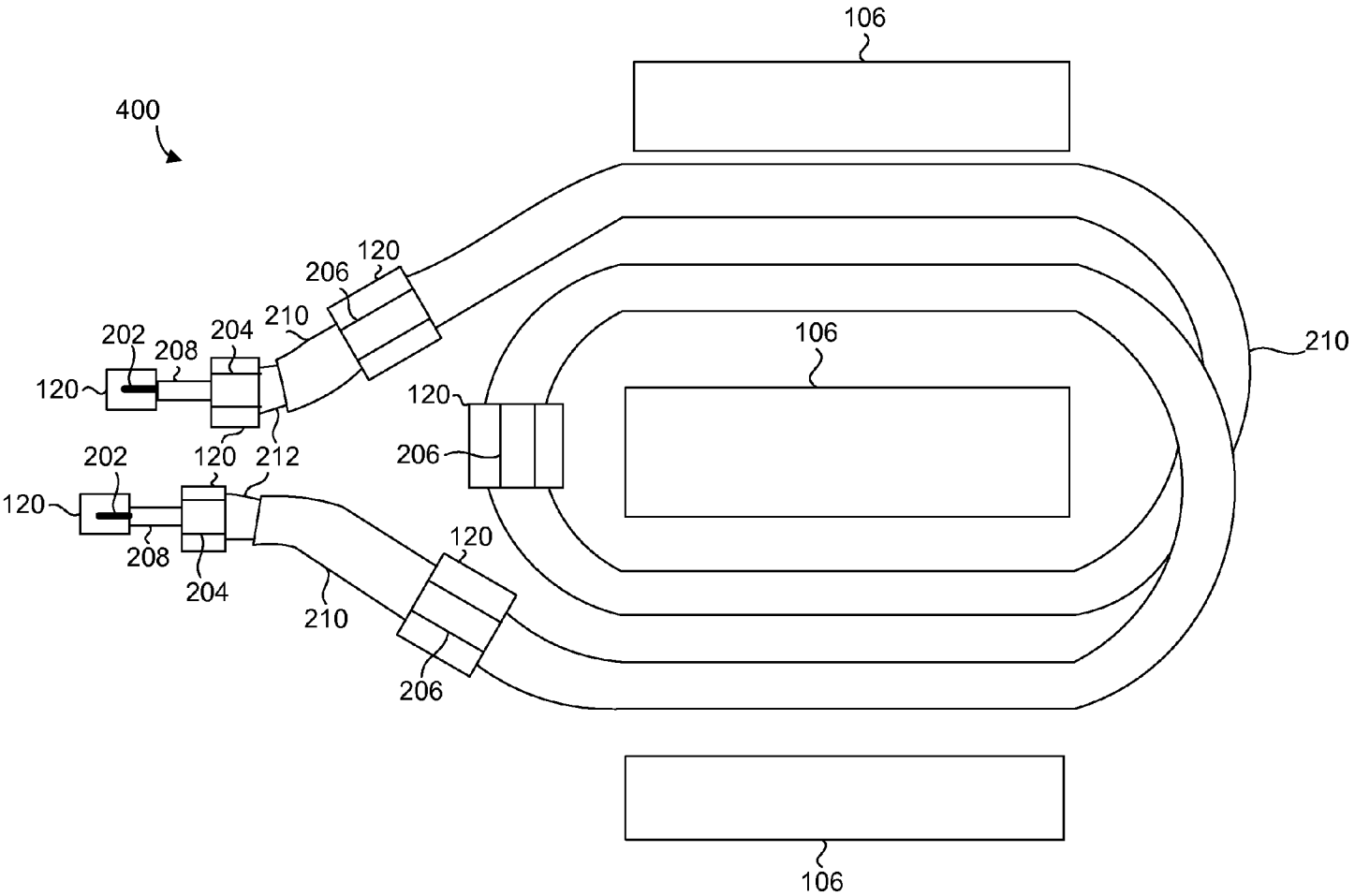
FIG. 7 illustrates an isolation transformer according to other embodiments of the disclosed technology.

In another embodiment, the triaxial cable shown in FIG. 5 can be wound around the magnetic core 106 two times, as shown in FIG. 7. Therefore, each primary winding and the two secondary windings have two turns in the isolation transformer 400. As can be seen in FIG. 7, the insulation layer 210 is removed around the braided sheath 206 in three spots. The braided sheath 206 acts as the primary winding and is soldered to soldering points 120 at these three spots. Finally, as in FIG. 5, the first secondary winding (braided sheath 204) and the second secondary winding (conductor 202) are also soldered to the circuit board at soldering points 120.

Figure 8:
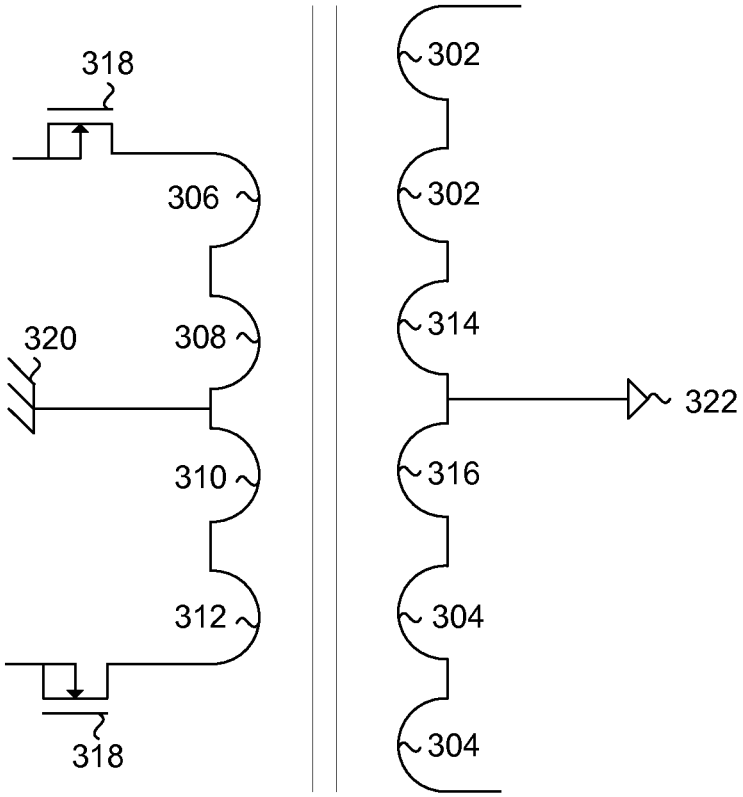
FIG. 8 illustrates a circuit diagram of an isolation transformer according to certain embodiments of the disclosed technology.
Figure 9:
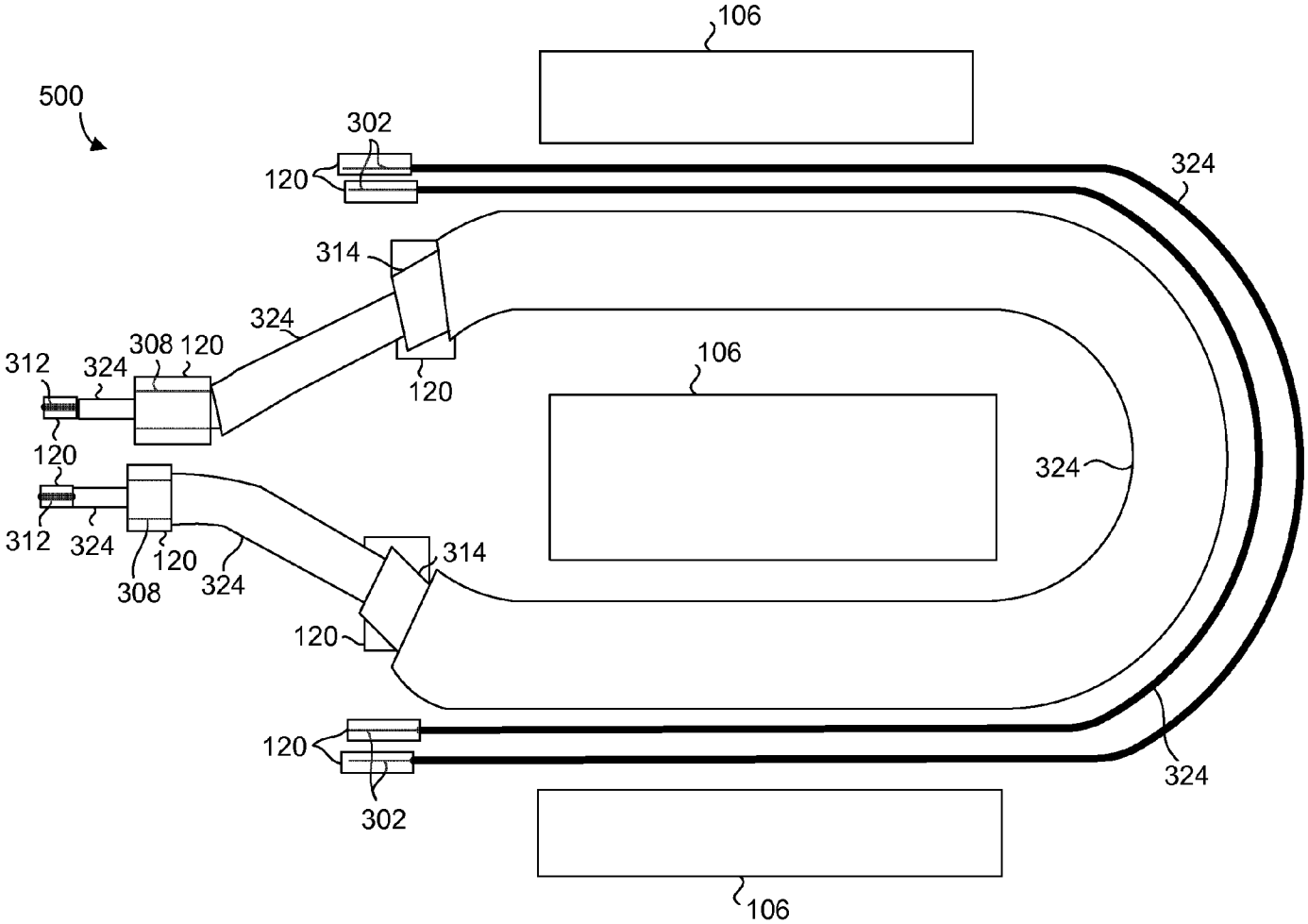
FIG. 9 illustrates an isolation transformer according to the embodiment shown in FIG. 8.

In another embodiment, shown in FIGS. 8 and 9, an isolation transformer is shown using two triaxial cables wound in parallel around a magnetic core. One triaxial cable is placed on the top of a circuit board and the other triaxial cable is placed on the bottom of the circuit board. For ease, the triaxial cables are referred to as the top cable and the bottom cable. The two cables are wound around a magnetic core 106. Further, four wires are provided external to the triaxial cable. Two wires 302, referred to herein as the top wires, are provided on the top of the circuit board, and two of the wires 304, referred to herein as the bottom wires, are provided on the bottom of the circuit board. The circuit diagram for such a configuration is shown in FIG. 8. An isolation transformer 500 on a top side of the circuit board is shown in FIG. 9. The isolation transformer on the bottom side of the circuit board would contain the same configuration as that shown in FIG. 9.

As can be seen in the circuit diagram of FIG. 8, the primary winding is composed of four turns including the bottom conductor 306, the top inner winding-shield 308, the bottom inner winding-shield 310, and the top conductor 312. The secondary winding includes six turns comprising the second top wire 302, the first top wire 302, the top outer winding-shield 314, the bottom outer winding-shield 316, the first bottom wire 304, and the second bottom wire 304. The bottom conductor 306 and the top conductor 312 of the primary winding are each connected to MOSFET switches 318. The top inner winding-shield 308 and the bottom inner winding-shield 310 are both connected to a primary ground (earth ground) 320. In the secondary winding, the top outer winding-shield 314 and the bottom outer winding-shield 316 are connected to a secondary floating ground 322. Each of these components is shown in FIG. 9. Further, soldering points 120 and insulation layers 324 are shown. In this configuration, the inner winding-shields 308 and 310 and the outer winding-shields 314 and 316 act as both a turn of the windings and winding-shields, as discussed above with respect to FIG. 4.

In an alternative to this embodiment, more than two transformers can be wound in parallel around the magnetic core 106. Further, in another alternative to this embodiment, coaxial cables may be used in place of the triaxial cables.

Each of the isolation transformers described above in the various embodiments, wherein the primary winding and the secondary winding have no direct coupling, have provided noise across the isolation barrier magnitudes lower than previously used isolation transformers.

In each of these embodiments, the magnetic core 106 may be ferrite for example. However, any type of magnetic core known in the art may be used. Further, the braided sheaths of the triaxial cables and the double-shielded cables should be of the highest quality. If the braided sheaths are not of the highest quality, the primary winding and the secondary windings may be able to couple directly through the winding-shields and provide electrical noise. The better the quality of the braided sheaths, the less electrical noise provided through the isolation transformer.

Having described and illustrated the principles of the disclosed technology in a preferred embodiment thereof, it should be apparent that the disclosed technology can be modified in arrangement and detail without departing from such principles. We claim all modifications and variations coming within the spirit and scope of the following claims.

What is claimed is:

1. An isolated DC-to-DC switching power supply, comprising:

an isolation power transformer including:

a magnetic core;

a first winding around the magnetic core;

a first electrostatic winding-shield around the magnetic core;

a second electrostatic winding-shield within the first electrostatic winding-shield; and a second winding within the second electrostatic winding-shield, such that the first winding electrostatically couples to the first electrostatic winding-shield and the second winding electrostatically couples to the second electrostatic winding-shield, such that there is no charge flow between the first electrostatic winding-shield and the second electrostatic winding-shield; and wherein each of the first winding, the first electrostatic winding-shield, the second electrostatic winding-shield and the second winding are affixed to a printed circuit board.

2. The isolated DC-to-DC switching power supply of claim 1, wherein the isolation power transformer further includes a double-shielded cable comprising the first electrostatic winding-shield as an outer conductor of the double-shielded cable, the second electrostatic winding-shield as the inner conductor of the double-shielded cable, and the second winding as the center conductor of the double-shielded cable, and the first winding is a wire external to the double electrostatic winding-shielded cable.

3. The isolated DC-to-DC switching power supply of claim 1, in which the first electrostatic winding-shield is the first electrostatic winding-shield and a part of the first winding.

4. The isolated DC-to-DC switching power supply of claim 2, in which the first electrostatic winding-shield is the first electrostatic winding-shield and a part of the first winding.

5. The isolated DC-to-DC switching power supply of claim 1, in which the first electrostatic winding-shield is the first electrostatic winding-shield and all of the first winding.

6. The isolated DC-to-DC switching power supply of claim 2, in which the first electrostatic winding-shield is the first electrostatic winding-shield and all of the first winding.

7. The isolated DC-to-DC switching power supply of claim 1, in which the second electrostatic winding-shield is the second electrostatic winding-shield and part of the second winding.

8. The isolated DC-to-DC switching power supply of claim 2, in which the second electrostatic winding-shield is the second electrostatic winding-shield and part of the second winding.

9. The isolated DC-to-DC switching power supply of claim 1, in which the second electrostatic winding-shield is the second electrostatic winding-shield and all of the second winding.

10. The isolated DC-to-DC switching power supply of claim 2, in which the second electrostatic winding-shield is the second electrostatic winding-shield and all of the second winding.

11. The isolated DC-to-DC switching power supply of claim 1, wherein the isolation power transformer further includes a coaxial cable comprising a first electrostatic winding-shield as an outer conductor of the coaxial cable, and a center conductor is the second electrostatic winding-shield and the second winding, the first winding is a wire external to the coaxial cable.

12. The isolated DC-to-DC switching power supply of claim 1, wherein the isolation power transformer further includes a coaxial cable in which the outer conductor of the coaxial cable is the first winding and the first electrostatic winding-shield, and a center conductor is the second electrostatic winding-shield and the second winding.

13. The isolation power transformer of claim 2, wherein a plurality of double-shielded cables are wound in parallel through the magnetic core and connected together to create the first electrostatic winding-shield, the second electrostatic winding-shield, and the second winding.

14. The isolation power transformer of claim 11, wherein a plurality of coaxial cables are wound in parallel through the magnetic core and connected together to create the first electrostatic winding-shield, the second electrostatic winding-shield, and the second winding.

* * * * *